United States Patent [19]

Damratowski et al.

[11] 4,399,914

[45] Aug. 23, 1983

[54] PILFER RESISTANT CONTAINER

[75] Inventors: Harold Damratowski, Alda; Jerry Jenson, Grand Island, both of Nebr.

[73] Assignee: Triad Corporation, Alda, Nebr.

[21] Appl. No.: 369,091

[22] Filed: Apr. 16, 1982

[51] Int. Cl.[3] ..... B65D 83/04

[52] U.S. Cl. ..... 206/533; 206/538; 221/154

[58] Field of Search ..... 206/533, 538; 220/352; 215/6, 254; 221/152, 154, 302

[56] References Cited

U.S. PATENT DOCUMENTS

| | | | |
|---|---|---|---|
| 2,169,686 | 8/1939 | Fabrice | 215/254 |
| 2,236,224 | 3/1941 | Raschkind | 206/533 |
| 3,394,796 | 7/1968 | Jensen | 206/533 |
| 3,450,252 | 6/1969 | Hallerbach | 206/533 |
| 3,561,592 | 2/1971 | McCool | 206/533 |
| 4,069,942 | 1/1978 | Marshall et al. | 221/154 |
| 4,083,452 | 4/1978 | Rossmo | 206/533 |

*Primary Examiner*—William T. Dixson, Jr.
*Assistant Examiner*—Brenda J. Ehrhardt
*Attorney, Agent, or Firm*—Frost & Jacobs

[57] ABSTRACT

A container for holding small parts and the like of cylindrical construction having a body with a number of wedge-shaped cavity compartments closed by a rotatable lid having an opening for accessing each of the cavities. A tab removably closes the opening and contains a pair of stops which project into one of the cavities. The tabs interact with the walls defining the cavities in the body portion to prevent rotation of the lid until the tab has been removed, thereby preventing pilferage of the container contents. The lid is joined to the body by a snap fit.

10 Claims, 5 Drawing Figures

PILFER RESISTANT CONTAINER

SUMMARY OF THE INVENTION

The present invention is directed to a unique construction for small molded plastic containers of the type commonly used to hold pharmaceuticals, small parts or other items. The construction prevents access to the contents of the container until a non-replaceable tab has been removed thus resisting pilferage and signifying to the consumer that the contents of the container have been tampered with.

In a preferred embodiment, the container is of relatively shallow construction and includes a cylindrical body portion having a plurality of wedge-shaped cavity sections defined by radially extending walls. A matching cylindrical lid section is rotatably secured to the body section by a snap fit and contains a wedge-shaped opening for accessing each section in turn as the lid is rotated with respect to the body portion.

A removable tab molded as a part of the lid closes the opening, and is attached to the lid by a number of frangible connections. The container is opened by severing the tab from the lid and discarding it.

A pair of spaced tab-like stops project inwardly from the bottom surface of the tab and are positioned close to the adjoining radially extending walls defining the cavity immediately underlying the opening. The stops prevent rotation of the lid with respect to the body until the tab has been removed. The cavity section located immediately beneath the opening is shallower than the other cavity sections, and will normally not dispense any items carried by the container.

Once the container has been opened, a pair of stops projecting inwardly from the under surface of the lid on either side of the opening cooperate with the body walls to hold the lid in place so that the opening is positioned over any of the cavity sections.

In the preferred embodiment, the lid and body are molded from plastic or other material as separate parts, and are rotatably joined together by a snap fit.

Further features of the invention will become apparent from the detailed description which follows.

DETAILED DESCRIPTION

Figure 1:
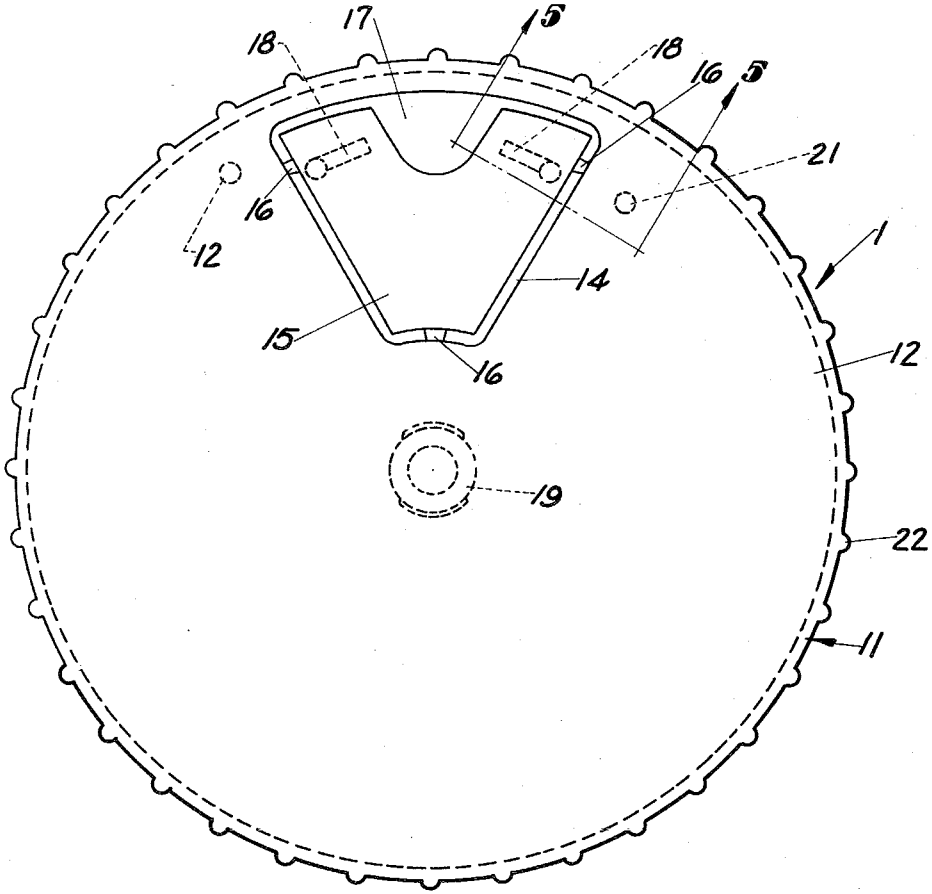
FIG. 1 is a top plan view of the container of the present invention.

The tamper resistant container of the present invention is illustrated generally at 1 in FIG. 1. Container 1 is of generally cylindrical construction and includes a cylindrical body portion 2 having a round bottom 3 and a circumferentially extending side wall 4. A plurality of wedge-shaped cavity sections, one of which is shown at 5 are defined by rib-like walls 6 extending radially outwardly from the center of body 2. One of the cavity sections **5*a* of shallower depth than the other cavity sections, and will normally not be used to hold items contained in the container as will be described in more detail hereinafter. The bottom of shallower cavity section 5*a* is formed by a false bottom portion 7 containing a round hole 8 by which the container 1** may be hung on a suitable support (not shown) for display.

The center of body 2 forms a cylindrical-shaped hub 9 extending completely through the body, and having at its upper end an inwardly extending circumferentially disposed rib or edge 10 for mating with the lid as will be described hereinafter.

Figure 2:
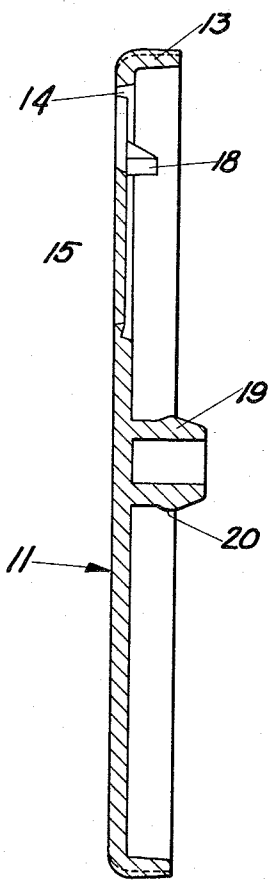
FIG. 2 is a side elevation cross sectional view of the lid portion of the container of the present invention.

The lid portion of the container 1 of the present invention is illustrated generally at 11 in FIG. 1 and FIG. 2. Lid 11 is of generally cylindrical construction and includes a round upper part 12 surrounded at its outer edge by a wall 13 having an inner diameter slightly greater than the outer diameter of wall 4 of body 2. The upper part 12 of lid 11 contains a trapezoidal-shaped opening 14 of the same or slightly smaller dimensions than a corresponding one of wedge-shaped cavity sections 5 or **5*a*. In all events, opening 14** will be of sufficient size to access the items contained in any of the cavity sections.

Opening 14 is closed by means of a correspondingly shaped removable tab 15 as can best be seen in FIG. 1. Tab 15 is dimensioned slightly smaller than opening 14 so as to fit therewithin and be attached to the surrounding part of lid 11 by a number of frangible appendages 16. Appendages 16 are fabricated so that tab 15 may be severed or torn away from the lid to expose opening 14. In a preferred embodiment, lid 11, tab 15 and the attaching appendages 16 may be cast or molded from plastic or the like at one time. To facilitate removing the tab from the lid, a cut-out 17 is provided in the outermost edge of tab 15 of sufficient size so that a finger may be inserted into the cut-out for lifting or pulling the tab away from the lid.

Figure 5:
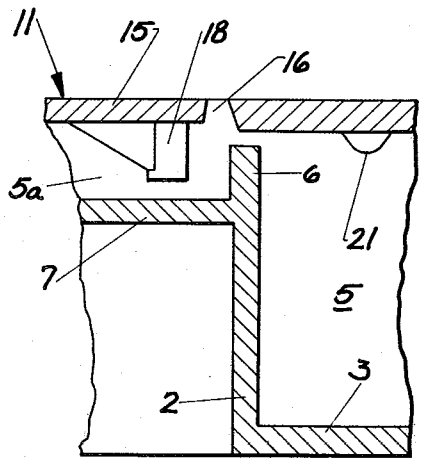
FIG. 5 is an enlarged fragmentary cross sectional view taken along section line 5—5 of FIG. 1.
Figure 4:
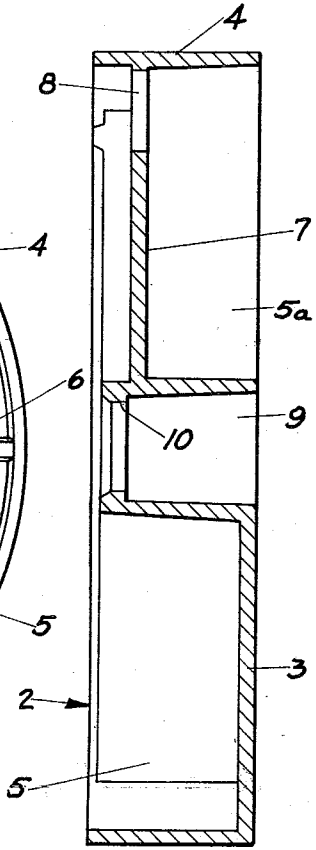
FIG. 4 is a side elevation cross sectional view of the body portion of the container of the present invention.
Figure 3:
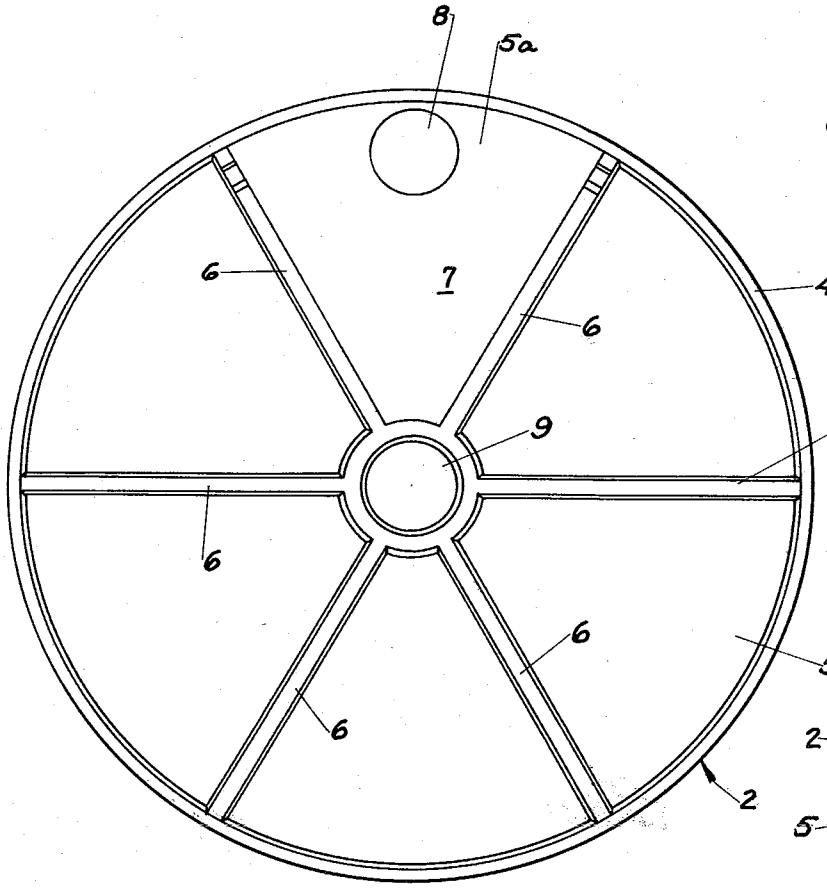
FIG. 3 is a top plan view of the body portion of the container of the present invention.

Means are also provided in connection with the tab for preventing rotation of the lid until the tab has been removed in order to defeat pilferage of the contents of the container. In the preferred embodiment illustrated, these means comprise a pair of spaced tab-like stops 18 which are attached to the under surface of the lid top 12 so as to extend downwardly into body portion 2 when the lid is attached to the body. Stops 18 are oriented more or less parallel to the lid wall 13 and are positioned on either side of cut-out 17. As illustrated in FIG. 5, each stop is shorter than the depth of the shallowest cavity section **5*a*, but long enough to contact the inner surface of walls 6 as the lid is rotated. It will be observed that stops 18 abut the adjoining wall 6 as the lid is rotated, thereby preventing further rotation of the lid until the stops are removed by removing the attached tab. It will be understood that stops 18** may be molded or cast as an integral part of the tab.

The central part of lid 11 is provided with a shaft portion 19 having an enlarged lower end as at 20. Shaft 19 is dimensioned and configured to fit into hub 9 of body 2 so that enlarged portion 20 engages rib or edge 10 with a snap fit to securely but rotatably hold the lid and body together. Once the lid and body have been snapped together, it will be very difficult, if not impossible, to separate them, thus further defeating tampering with the contents of the container.

A projection 21 also protrudes inwardly from the under surface of lid top 12 on either side of opening 14, and serve as stops to limit rotation of the lid with respect to the body after tab 15 has been removed. It will be observed that projections 21 are spaced so as to lie on the outside of their adjoining walls 6, and are of such a height so as to project slightly below the upper edge of wall 6 as illustrated in FIG. 5. Consequently, once the lid has been rotated so that opening 14 overlies a particular cavity section 5, the lid will be held in this position by the interaction between projections 21 and the adjoining walls. However, if it is desired to rotate the lid to a new position, the slightly resilient nature of the lid is such that projections 21 will ride up and over the top of the wall so that the lid may be rotated.

Lid 11 and/or body 2 may be constructed of any suitable plastic, particularly a transparent plastic so that the contents of the container 1 may be seen. In normal use, all of the cavity sections with the exception of cavity section 5*a* will be filled with the contents of the container such as pharmaceuticals, small parts or the like. Normally, the shallower cavity section will be left empty. After the tab has been removed as hereinabove described, the lid may be rotated so that opening 14 overlies any of the cavity sections to access the contents thereof. To facilitate turning the lid, the outer edge thereof may be provided with a number of spaced rigids, one of which is shown at 22 in FIG. 1.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. A generally cylindrical container having a body portion including a plurality of cavity sections defined by radially extending walls and a lid portion rotatably secured to the body portion and containing an opening therein for accessing each section in turn as the lid portion is rotated with respect to the body portion, a removable tab closing said opening, said tab including means cooperating with said body portion to prevent rotation of the lid until the tab has been removed, thereby defeating pilferage of the contents.

2. The container according to claim 1 wherein said rotation preventing means comprises means attached to said lid and extending into said body portion.

3. The container according to claim 2 wherein said means comprises at least one stop projecting inwardly from the bottom surface of the tab and positioned so as to contact the walls to prevent rotation of the lid.

4. The container according to claim 3 including a pair of spaced stops positioned on said tab adjacent different walls.

5. The container according to claim 4 wherein said stops extend into one of the cavity sections.

6. The container according to claim 5 wherein said one cavity section is shallower than the other cavity sections.

7. The container according to claim 5 wherein said tab is frangibly attached to the lid.

8. The container according to claim 3 including a stop positioned on the under surface of the lid on either side of the opening, said last mentioned stops locking said lid against rotation after the tab has been removed.

9. The container according to claim 8 wherein said lid and body are separate parts rotatably joined by a snap fit.

10. The apparatus according to claim 3 wherein said stops extending into one of the cavity sections, said one cavity section being shallower than the other cavity sections, said tab being frangibly attached to the lid, said lid further including a stop positioned on the under surface thereof on either side of the opening, said last mentioned stops locking said lid against rotation after the tab has been removed, and wherein said lid and body are separate parts rotatably joined by a snap fit.

* * * * *